US006742288B2

(12) United States Patent
Choi

(10) Patent No.: US 6,742,288 B2
(45) Date of Patent: Jun. 1, 2004

(54) SPORTS SHOE

(76) Inventor: Yun-ja Choi, Hanshin apt. #103-1103, 880-84, Mangmi 1 dong, Sooyoung-ku, Pusan (KR)

( * ) Notice: Subject to any disclaimer, the term of this patent is extended or adjusted under 35 U.S.C. 154(b) by 17 days.

(21) Appl. No.: 10/224,184

(22) Filed: Aug. 20, 2002

(65) Prior Publication Data

US 2004/0035025 A1 Feb. 26, 2004

(51) Int. Cl.[7] ..... A43B 5/00; A43B 13/00

(52) U.S. Cl. ..... 36/132; 36/103; 36/30 A; 36/3 R

(58) Field of Search ..... 36/102, 103, 30 R, 36/30 A, 132, 136, 3 R, 3 B

(56) References Cited

U.S. PATENT DOCUMENTS 3,785,646 A * 1/1974 Ruskin ..... 36/132
4,384,414 A * 5/1983 Gamm ..... 36/132
4,430,810 A * 2/1984 Bente ..... 36/136
4,445,284 A * 5/1984 Sakutori ..... 36/3 B
4,598,487 A * 7/1986 Misevich ..... 36/136
4,611,416 A * 9/1986 Lin ..... 36/136
4,612,714 A * 9/1986 Gamm ..... 36/136
4,813,160 A * 3/1989 Kuznetz ..... 36/3 R
4,939,851 A * 7/1990 Miller ..... 36/3 B
5,893,223 A * 4/1999 Glass ..... 36/132
5,921,003 A * 7/1999 Kim ..... 36/3 B
6,397,498 B1 * 6/2002 Yoo ..... 36/132
6,502,331 B2 * 1/2003 Hines ..... 36/132

* cited by examiner

*Primary Examiner*—Anthony D. Stashick
(74) *Attorney, Agent, or Firm*—Notaro & Michalos P.C.

(57) ABSTRACT

Disclosed is a sports shoe having a shell 26, an inner sole 10, a middle sole 16, and sponges 12 and 14 attached between the inner sole 10 and the middle sole 16, including: a space part 17 formed within the middle sole 16; a first metallic rod 18*a* and a polyvinyl chloride (PVC) pipe 20 constantly spaced apart each other and inserted into the space part 17; and a second metallic rod 18*b* being detachably inserted into the PVC pipe 20.

3 Claims, 4 Drawing Sheets

28a
100
32a
30
26
28
32
24
10
24
12
14
17
18a
18a
16
20
20
18b
22

100

10
12
14
18b
24
24
20
18a
26
16
19

SPORTS SHOE

BACKGROUND OF THE INVENTION

1. Field of the Invention

The present invention relates generally to a sports shoe, and in particular, to a sports shoe for training a physical body in which a plurality of metallic rods and PVC pipes are inserted into a middle sole of the sports shoe, thereby weighting the sports shoe, and also in which the metallic rod is detachably inserted into the PVC pipe, thereby controlling a weight of the sports shoe.

2. Description of the Related Art

In general, the sports shoe made of a leather material or a rubber material is comprised of a shell for an outer shape, and a bottom element having an inner sole, a middle sole and an outer sole. The general sports shoe does not have a function of training the physical body. That is, the general sports shoe has only a basic function of a shoe. Therefore, there have been disadvantages in which the general public or sports players have a trouble of wearing a sandbag or the like on the calf so as to reinforce a muscle of a lower part of the body, even though they wear the sports shoe, and they cannot maintain exercising because the sandbag or the like slides down during exercising.

In order to solve the above-mentioned disadvantages, there has been provided the conventional sports shoe in which a weighting element such as a plurality of iron beads, a metallic plate or the like is inserted inside a bottom sole of the sports shoe, whereby the sports shoe being constantly weighted. However, the conventional sports shoe has a disadvantage in which because the iron beads inserted are not equally filled in the bottom sole, the weight of the sports shoe is biased to thereby deteriorate a wearer's a comfort for foot and a manufacture process become longer, and in which the metallic plates are not bent due to a deterioration of an elasticity thereof to thereby suffer a fracture of the wearer's toe or ankle while wearing the sports shoe. Also, there has been a disadvantage in which the iron beads or the metallic plates are not detachable after being inserted, thereby not controlling the weight of the sports shoe.

SUMMARY OF THE INVENTION

It is, therefore, an object of the present invention to provide a sports shoe for training a physical body in which a plurality of metallic rods and PVC pipes are inserted inside the middle sole of the sports shoe at the time of shaping the middle sole, thereby weighting the sports shoe, and in which the metallic rod is inserted inside the PVC pipe through a circular opening thereof, thereby controlling a weight of the sports shoe.

It is another object of the present invention to provide a sports shoe in which circular ventilation openings are shaped and constantly spaced apart each other on the PVC pipes and on the inner sole, so that an external air can be flowed into PVC pipes and the inner sole through the circular ventilation openings thereof for ventilation.

It is a still another object of the present invention to provide a sports shoe in which slide fasteners are respectively installed on a cover formed in a center of the shell of the sports shoe and on both sides of the shell of the sports shoe so as to respectively detachably insert weighting elements into the slide fasteners thereof, thereby controlling the weight of the sports shoe having the slide fasteners.

In order to achieve the above-mentioned objects, a sports shoe of the present invention having a shell, an inner sole, a middle sole, and sponges attached between the inner sole and the middle sole, comprises a space part formed within the middle sole; a first metallic rod and a polyvinyl chloride (PVC) pipe constantly spaced apart from each other and inserted into the space part; and a second metallic rod being detachably inserted into the PVC pipe.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
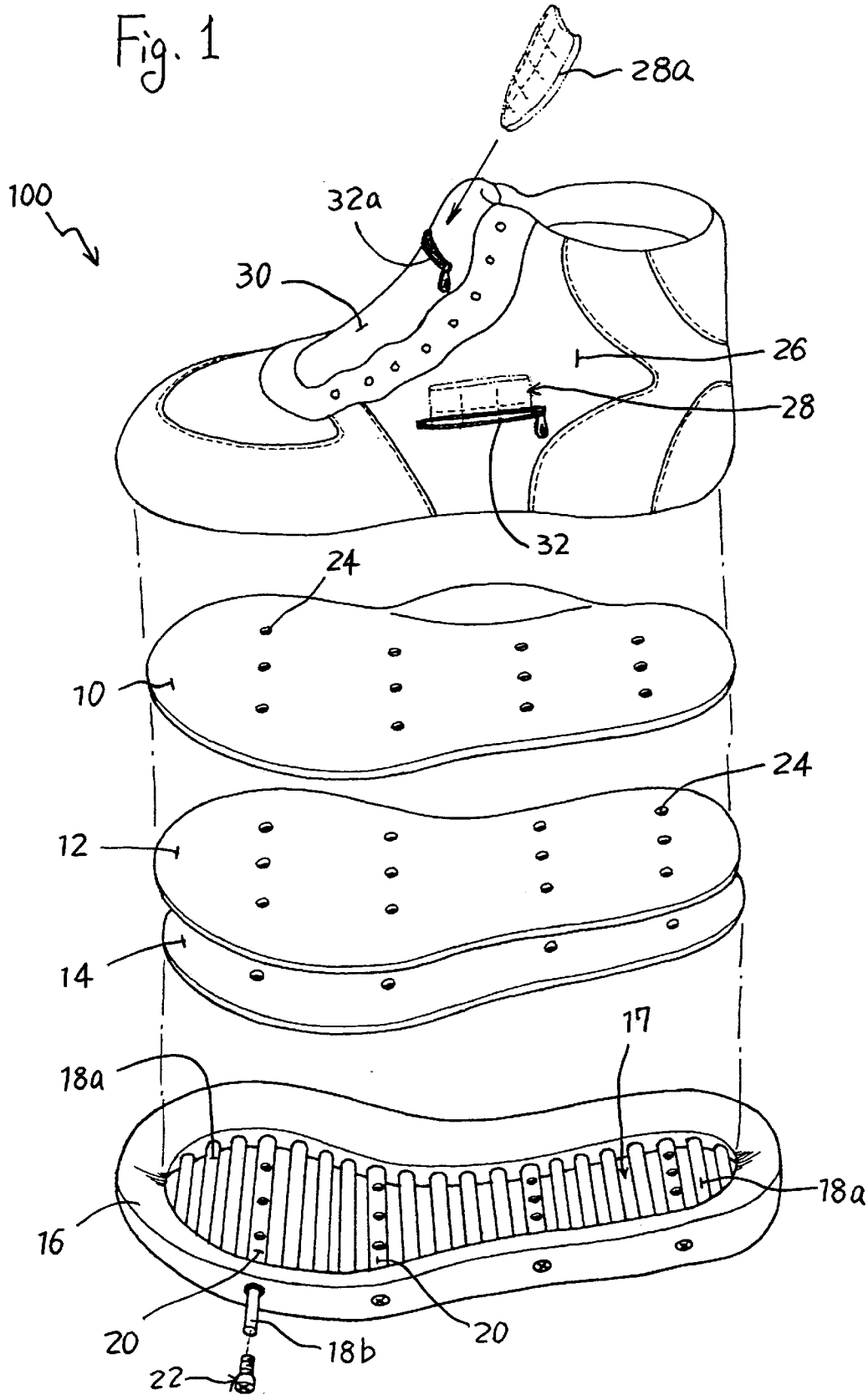
FIG. 1 is a perspective view of illustrating an entire disassembly of a sports shoe according to a preferred embodiment of the present invention.
Figures 2A, 2B:
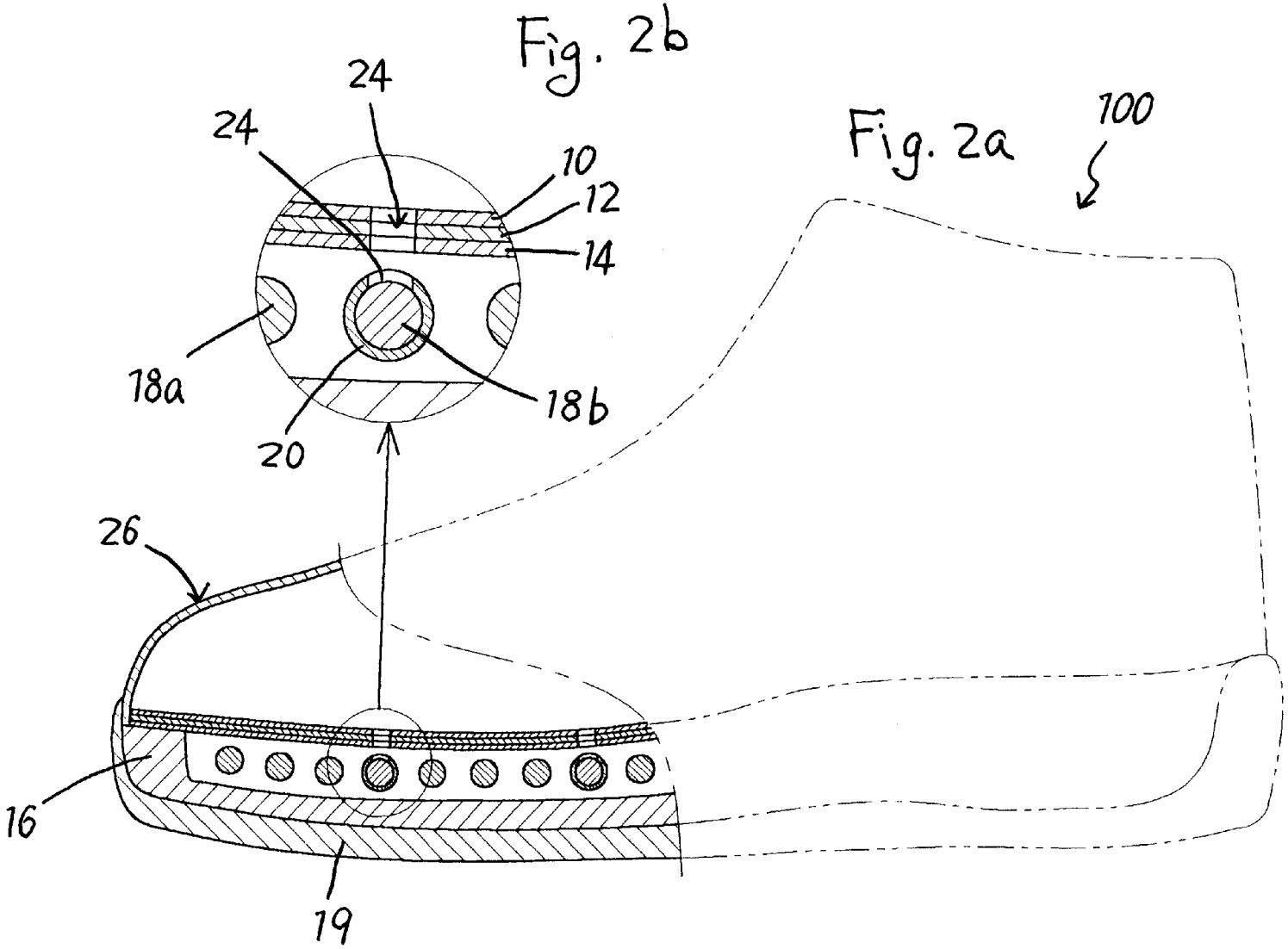
FIG. 2*a* is a partial cross-sectional view of illustrating an entire assembly of a shorts shoe of FIG. 1.
FIG. 2*b* is an enlarged detail of FIG. 2*a;*
Figure 3:
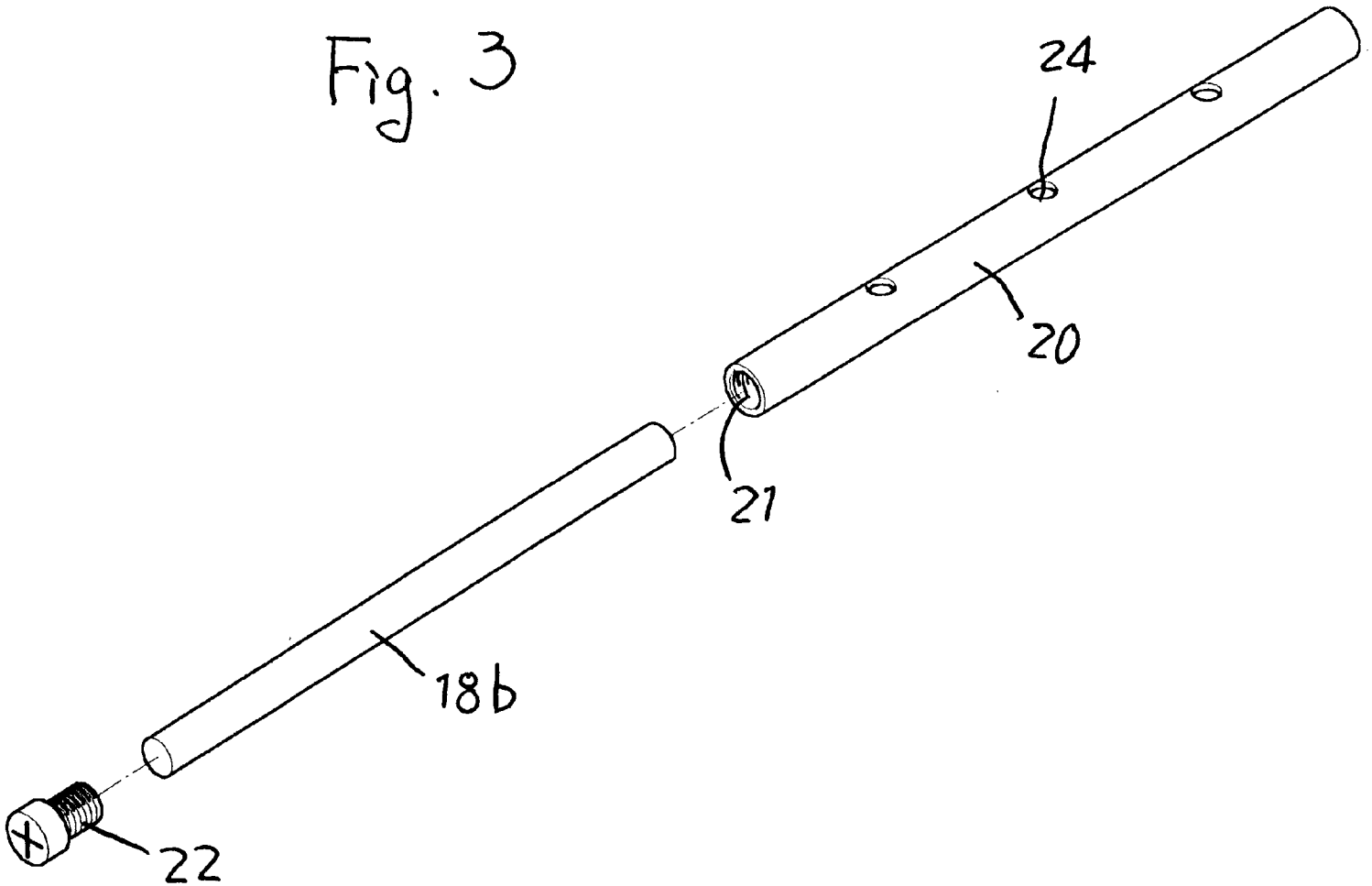
FIG. 3 is a perspective view of illustrating an entire assembly of a metallic rod and a polyvinyl chloride (PVC) pipe shown in FIG. 1.

FIG. 1 is a perspective view of illustrating an entire disassembly of a sports shoe according to a preferred embodiment of the present invention, and FIG. 2*a* is a partial cross-sectional view of illustrating an entire assembly of the sports shoe of FIG. 1, and FIG. 3 is a perspective view of illustrating an entire combination of a second metallic rod and a polyvinyl chloride (PVC) pipe shown in FIG. 1.

Referring to FIGS. 1 to 3, the sports shoe according to the present invention generally comprises a shell 26 for an outer shape of the sports shoe 100, an inner sole 10 for a bottom surface, a middle sole 16 having a space part 17 therein, and an outer sole 19.

As shown in FIG. 1, the space part 17 of the middle sole 16 is provided with a plurality of a metallic rod 18*a* and a Polyvinyl Chloride (PVC) pipe 20. That is, the metallic rod 18*a* and the PVC pipe 20 are inserted within a metal frame (not shown) for shaping the middle sole 16 to thereby perform a press process, so that the metallic rod 18*a* and the PVC pipe 20 can be constantly spaced apart from each other and fixedly inserted within the space part 17 of the middle sole 16. At this time, the PVC pipe 20 can be made by one of several materials, and most preferably, by a plastic material.

On the other hand, as shown in FIGS. 1 and 3, a circular opening 21 is formed in one end of the PVC pipe 20, and the metallic rod 18*b* is inserted into the circular opening 21. Also, a screw cap 22 is engaged with a screw thread threaded along with an inside circular surface of one end of the circular opening 21, thereby preventing the metallic rod 18*b* from being separated from the circular opening 21.

And, an inner sole 10 is attached to an upper surface of the middle sole 16. At this time, at least two folded sponges 12 and 14, preferably, high elastic sponges are attached between the inner sole 10 and the middle sole 16, so as to alleviate an external shock generated during exercising.

Also, as shown in FIGS. 1 and 3, an upper surface of the PVC pipe 20 inserted into the middle sole 16, the inner sole 10 and the high elastic sponges 12 and 14 are respectively provided with a circular ventilation opening 24. An external air is flowed into the PVC pipe 20 and the inner sole 10 through the circular ventilation opening 24 thereof. That is, more preferably, the screw cap 22 is released from one end of the PVC pipe 20 and then the metallic rod 18*b* is removed from the PVC pipe 20, so that the external air can be flowed into the PVC pipe 20. The air is flowed inside the sports shoe through the circular ventilation opening 24 respectively formed on the PVC pipe 20, the high elastic sponges 12 and 14, and the inner sole 10.

Figure 4A:
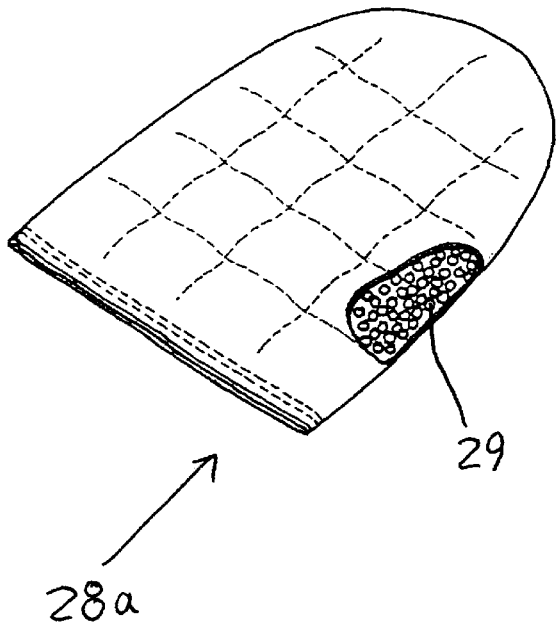
FIG. 4*a* and FIG. 4*b* are views illustrating two weighting elements inserted into a sports shoe shown in FIG. 1.
Figure 4B:
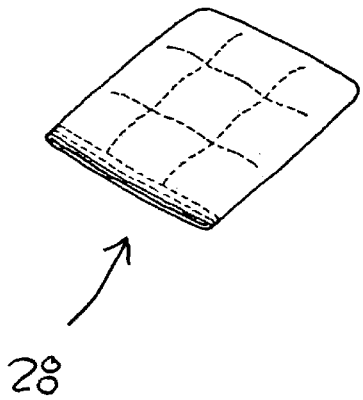

On the other hand, the shell 26 forming the outer shape of the sports shoe 100 is attached onto the upper surface of the inner sole 10 and the middle sole 16. At this time, slide fasteners 32*a* and 32 are respectively attached onto a cover 30 formed in a center of the shell 26 and onto both sides of the shell 26. As shown in FIGS. 1, 4*a* and 4*b*, the weighting elements 28*a* and 28 having a plurality of the iron beads 29 therein are detachably inserted inside the slide fasteners 32*a* and 32.

In the following, described will be a using state of the sports shoe according to the present invention with reference to FIGS. 1 to 3. First, in case that a user wears the sports shoe in which the metallic rod 18*b* is inserted into the PVC pipe 20 through the circular opening 21 thereof and the screw cap 22 is engaged with one end of the PVC pipe 20, the user can train a lower part of the body even without wearing the sandbag or the like. Also, in case that the user desires to decrease the weight of the sports shoe, the user can release the screw cap 22 and then remove the metallic rod 18*b* from the PVC pipe 20, thereby easily decreasing the weight of the sports shoe 100.

Also, at the time of removing the metallic rod 18*b* from the PVC pipe 20, the external air is flowed into the PVC pipe 20. And then, the air is flowed within the sports shoe through the circular ventilation openings 24 respectively formed on the PVC pipe 20, the high elastic sponges 12 and 14, and the inner sole 10, for ventilation.

On the other hand, other weighting elements 28*a* and 28 can be inserted into the slide fasteners 32*a* and 32. The slide fasteners 32*a* and 32 are respectively installed on the cover 30 formed in the center of the shell 26 and on both sides of the shell 26, thereby controlling the weight of the sports shoe 100.

As described above, the sports shoe for training a physical body according to the present invention has an advantage in which a plurality of metallic rods and PVC pipes are inserted inside a middle sole of the sports shoe at the time of shaping the middle sole, thereby weighting the sports shoe, and which the metallic rods are detachably inserted inside the PVC pipes through a circular opening thereof, thereby controlling a weight of the sports shoe. Also, the sports shoe according to the present invention has an advantage in which circular ventilation openings are shaped and constantly spaced apart on the PVC pipes and the inner soles, so that an external air can be flowed into the PVC pipes and the inner soles through the circulation ventilation openings thereof for ventilation. Also, the sports shoe according to the present invention has another advantage in which slide fasteners are installed on a cover formed in a center of the shell and on both sides of the shell of the sports shoe, so as to respectively detachably inserting weighting elements into the slide fasteners, thereby controlling the weight of the sports shoe.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A sports shoe having a shell (26), an inner sole (10), a middle sole (16), and sponges (12, 14) attached between the inner sole (10) and the middle sole (16), comprising:

a space part (17) formed within the middle sole (16);

a first metallic rod (18*a*) and a polyvinyl chloride (PVC) pipe (20) constantly spaced apart from each other and inserted into the space part (17); and a second metallic rod (18*b*) being detachably inserted into the PVC pipe (20).

2. The sports shoe as claimed in claim 1, wherein a circular ventilation opening (24) is formed on the inner sole (10), the sponges (12, 14), and the PVC pipe (20).

3. The sports shoe as claimed in claim 1, wherein slide fasteners (32*a*, 32) are respectively installed on a cover (30) in a center of the shell (26) and on both sides of the shell (26), and weighting elements (28*a*, 28) are detachably inserted into the slide fasteners (32*a*, 32).

* * * * *